US009005432B2

(12) United States Patent
Choi et al.

(10) Patent No.: US 9,005,432 B2
(45) Date of Patent: Apr. 14, 2015

(54) REMOVAL OF SULFUR COMPOUNDS FROM PETROLEUM STREAM

(75) Inventors: Ki-Hyouk Choi, Dhahran (SA); Mohammad Fuad Aljishi, Qatif (SA); Ashok K. Punetha, Dhahran (SA); Mohammed R. Al-Dossary, Eastern Region (SA); Joo-Hyeong Lee, Ras Tanura (SA); Bader M. Al-Otaibi, Dammam (SA)

(73) Assignee: Saudi Arabian Oil Company (SA)

( * ) Notice: Subject to any disclaimer, the term of this patent is extended or adjusted under 35 U.S.C. 154(b) by 1196 days.

(21) Appl. No.: 12/825,842

(22) Filed: Jun. 29, 2010

(65) Prior Publication Data

US 2011/0315600 A1 Dec. 29, 2011

(51) Int. Cl.

| | |
|---|---|
| ***C10G 27/04*** | (2006.01) |
| ***C10G 27/14*** | (2006.01) |
| ***C10G 32/02*** | (2006.01) |
| ***C10G 19/02*** | (2006.01) |
| ***C10G 9/00*** | (2006.01) |
| ***C10G 21/02*** | (2006.01) |
| ***C10G 21/08*** | (2006.01) |
| ***C10G 31/08*** | (2006.01) |
| ***C10G 55/04*** | (2006.01) |

(52) U.S. Cl.

CPC *C10G 9/00* (2013.01); *C10G 19/02* (2013.01); *C10G 21/02* (2013.01); *C10G 21/08* (2013.01); *C10G 31/08* (2013.01); *C10G 55/04* (2013.01); *C10G 2300/1033* (2013.01); *C10G 2300/202* (2013.01); *C10G 2300/205* (2013.01); *C10G 2300/206* (2013.01); *C10G 2300/308* (2013.01); *C10G 2300/44* (2013.01); *C10G 2300/4081* (2013.01); *C10G 2300/805* (2013.01)

(58) Field of Classification Search

USPC ..... 208/177, 208 R, 226, 227, 228, 229

See application file for complete search history.

(56) References Cited

U.S. PATENT DOCUMENTS

| | | | |
|---|---|---|---|
| 2,880,171 | A | 3/1959 | Flinn et al. |
| 2,944,012 | A | 7/1960 | Thompson |

(Continued)

FOREIGN PATENT DOCUMENTS

| | | |
|---|---|---|
| EP | 0 199 555 A2 | 10/1986 |
| EP | 0341893 | 11/1989 |

(Continued)

OTHER PUBLICATIONS

Arturo J. Hernandez and Ralph T. Yang, "Desulfurization of Transportation Fuels by Adsorption", Catalysis Reviews (2004), pp. 111-150, vol. 46, No. 2.

(Continued)

*Primary Examiner* — Walter D Griffin
*Assistant Examiner* — Derek Mueller
(74) *Attorney, Agent, or Firm* — Bracewell & Giuliani LLP; Constance Gall Rhebergen

(57) ABSTRACT

A process for upgrading an oil stream by mixing the oil stream with a water stream and subjecting it to conditions that are at or above the supercritical temperature and pressure of water. The process further includes cooling and a subsequent alkaline extraction step. The resulting thiols and hydrogen sulfide gas can be isolated from the product stream, resulting in an upgraded oil stream that is a higher value oil having low sulfur, low nitrogen, and low metallic impurities as compared to the oil stream.

24 Claims, 3 Drawing Sheets

(56) References Cited

U.S. PATENT DOCUMENTS

| | | | | |
|---|---|---|---|---|
| 2,967,204 | A | | 1/1961 | Beuther et al. |
| 3,116,234 | A | | 12/1963 | Douwes et al. |
| 3,501,396 | A | | 3/1970 | Gatsis |
| 3,576,596 | A | | 4/1971 | Krane et al. |
| 3,586,621 | A | | 6/1971 | Pitchford et al. |
| 3,654,139 | A | | 4/1972 | Winsor et al. |
| 3,708,421 | A | | 1/1973 | Rippie |
| 3,733,259 | A | | 5/1973 | Wilson et al. |
| 3,830,752 | A | | 8/1974 | Mickelson |
| 3,842,014 | A | | 10/1974 | Friend et al. |
| 3,864,451 | A | | 2/1975 | Lee et al. |
| 3,948,754 | A | | 4/1976 | McCollum et al. |
| 3,948,755 | A | | 4/1976 | McCollum et al. |
| 3,960,706 | A | | 6/1976 | McCollum et al. |
| 3,960,708 | A | | 6/1976 | McCollum et al. |
| 3,988,238 | A | | 10/1976 | McCollum et al. |
| 3,989,618 | A | | 11/1976 | McCollum et al. |
| 4,005,005 | A | | 1/1977 | McCollum et al. |
| 4,082,695 | A | | 4/1978 | Rosinski et al. |
| 4,151,068 | A | | 4/1979 | McCollum et al. |
| 4,203,829 | A | | 5/1980 | Bertolacini |
| 4,210,628 | A | | 7/1980 | Ninomiya et al. |
| 4,325,926 | A | | 4/1982 | Blanton, Jr. |
| 4,464,252 | A | | 8/1984 | Eberly, Jr. |
| 4,483,761 | A | | 11/1984 | Paspek, Jr. |
| 4,485,007 | A | | 11/1984 | Tam et al. |
| 4,530,755 | A | | 7/1985 | Ritchie et al. |
| 4,544,481 | A | | 10/1985 | Seiver et al. |
| 4,594,141 | A | | 6/1986 | Paspek, Jr. et al. |
| 4,719,000 | A | | 1/1988 | Beckberger |
| 4,743,357 | A | | 5/1988 | Patel et al. |
| 4,762,814 | A | | 8/1988 | Parrott et al. |
| 4,813,370 | A | | 3/1989 | Capamaggio |
| 4,818,370 | A | | 4/1989 | Gregoli et al. |
| 4,840,725 | A | | 6/1989 | Paspek |
| 4,908,122 | A | | 3/1990 | Frame et al. |
| 5,087,350 | A | | 2/1992 | Paris-Marcano |
| 5,096,567 | A | | 3/1992 | Paspek, Jr. et al. |
| 5,167,797 | A | | 12/1992 | Ou |
| 5,278,138 | A | | 1/1994 | Ott et al. |
| 5,316,659 | A | | 5/1994 | Brons et al. |
| 5,411,658 | A | | 5/1995 | Chawla et al. |
| 5,421,854 | A | | 6/1995 | Kodas et al. |
| 5,439,502 | A | | 8/1995 | Kodas et al. |
| 5,466,363 | A | | 11/1995 | Audeh et al. |
| 5,496,464 | A | | 3/1996 | Piskorz et al. |
| 5,529,968 | A | | 6/1996 | Sudhakar et al. |
| 5,538,930 | A | | 7/1996 | Sudhakar et al. |
| 5,558,783 | A | | 9/1996 | McGuinness |
| 5,560,823 | A | * | 10/1996 | Whiting ..... 210/205 |
| 5,597,476 | A | | 1/1997 | Hearn et al. |
| 5,611,915 | A | | 3/1997 | Siskin et al. |
| 5,616,165 | A | | 4/1997 | Glicksman et al. |
| 5,626,742 | A | * | 5/1997 | Brons et al. ..... 208/235 |
| 5,676,822 | A | | 10/1997 | Sudhakar |
| 5,695,632 | A | | 12/1997 | Brons et al. |
| 5,837,640 | A | | 11/1998 | Sudhakar et al. |
| 5,851,381 | A | | 12/1998 | Tanaka et al. |
| 5,861,136 | A | | 1/1999 | Glicksman et al. |
| 5,906,730 | A | | 5/1999 | Hatanaka et al. |
| 5,928,497 | A | | 7/1999 | Iaccino |
| 5,958,224 | A | | 9/1999 | Ho et al. |
| 6,063,265 | A | | 5/2000 | Chiyoda et al. |
| 6,103,393 | A | | 8/2000 | Kodas et al. |
| 6,120,679 | A | | 9/2000 | Hatanaka et al. |
| 6,153,123 | A | | 11/2000 | Hampden-Smith et al. |
| 6,159,267 | A | | 12/2000 | Hampden-Smith et al. |
| 6,197,718 | B1 | | 3/2001 | Brignac et al. |
| 6,228,254 | B1 | | 5/2001 | Jossens et al. |
| 6,248,230 | B1 | | 6/2001 | Min et al. |
| 6,277,271 | B1 | | 8/2001 | Kocal |
| 6,303,020 | B1 | | 10/2001 | Podrebarac et al. |
| 6,316,100 | B1 | | 11/2001 | Kodas et al. |
| 6,325,921 | B1 | | 12/2001 | Andersen |
| 6,334,948 | B1 | | 1/2002 | Didillon et al. |
| 6,488,840 | B1 | | 12/2002 | Greaney et al. |
| 6,500,219 | B1 | | 12/2002 | Gunnerman |
| 6,551,501 | B1 | | 4/2003 | Whitehurst |
| 6,579,444 | B2 | | 6/2003 | Feimer et al. |
| 6,596,157 | B2 | | 7/2003 | Gupta et al. |
| 6,610,197 | B2 | | 8/2003 | Stuntz et al. |
| 6,623,627 | B1 | | 9/2003 | Zhou |
| 6,685,762 | B1 | | 2/2004 | Brewster et al. |
| 6,689,186 | B1 | | 2/2004 | Hampden-Smith et al. |
| 6,699,304 | B1 | | 3/2004 | Hampden-Smith et al. |
| 6,780,350 | B1 | | 8/2004 | Kodas et al. |
| 6,827,845 | B2 | | 12/2004 | Gong et al. |
| 6,881,325 | B2 | | 4/2005 | Morris et al. |
| 7,144,498 | B2 | | 12/2006 | McCall et al. |
| 7,264,710 | B2 | | 9/2007 | Hokari et al. |
| 7,435,330 | B2 | | 10/2008 | Hokari et al. |
| 7,780,847 | B2 | | 8/2010 | Choi |
| 7,842,181 | B2 | | 11/2010 | Choi |
| 2003/0062163 | A1 | | 4/2003 | Moulton et al. |
| 2003/0217952 | A1 | | 11/2003 | Brignac et al. |
| 2004/0007506 | A1 | | 1/2004 | Song et al. |
| 2004/0024072 | A1 | | 2/2004 | Lin et al. |
| 2004/0118748 | A1 | | 6/2004 | Lesemann et al. |
| 2004/0178123 | A1 | | 9/2004 | Podrebarac |
| 2004/0188327 | A1 | | 9/2004 | Groten |
| 2005/0040078 | A1 | | 2/2005 | Zinnen et al. |
| 2005/0067323 | A1 | | 3/2005 | Balko |
| 2005/0072137 | A1 | | 4/2005 | Hokari et al. |
| 2005/0075528 | A1 | | 4/2005 | Burkhardt et al. |
| 2005/0098478 | A1 | | 5/2005 | Gupta et al. |
| 2005/0167333 | A1 | | 8/2005 | McCall et al. |
| 2005/0173297 | A1 | | 8/2005 | Toida |
| 2005/0252831 | A1 | | 11/2005 | Dysard et al. |
| 2005/0284794 | A1 | | 12/2005 | Davis et al. |
| 2006/0011511 | A1 | | 1/2006 | Hokari et al. |
| 2006/0154814 | A1 | | 7/2006 | Zanibelli et al. |
| 2006/0163117 | A1 | | 7/2006 | Hong |
| 2007/0111319 | A1 | | 5/2007 | Bastide et al. |
| 2007/0227950 | A1 | | 10/2007 | Martinie et al. |
| 2007/0234640 | A1 | | 10/2007 | Jia et al. |
| 2008/0099373 | A1 | | 5/2008 | Hokari et al. |
| 2008/0099374 | A1 | | 5/2008 | He et al. |
| 2008/0099375 | A1 | | 5/2008 | Landau et al. |
| 2008/0099376 | A1 | | 5/2008 | He et al. |
| 2008/0099377 | A1 | | 5/2008 | He et al. |
| 2008/0099378 | A1 | | 5/2008 | He et al. |
| 2009/0032436 | A1 | | 2/2009 | Takahashi et al. |
| 2009/0139715 | A1 | | 6/2009 | Choi |
| 2009/0145807 | A1 | | 6/2009 | Choi et al. |
| 2009/0145808 | A1 | | 6/2009 | Choi et al. |
| 2009/0148374 | A1 | | 6/2009 | Choi |
| 2009/0230026 | A1 | | 9/2009 | Choi et al. |
| 2011/0024330 | A1 | | 2/2011 | Choi |

FOREIGN PATENT DOCUMENTS

| | | | |
|---|---|---|---|
| EP | 1454976 | | 9/2004 |
| EP | 1 537 912 | A1 | 6/2005 |
| EP | 1577007 | | 9/2005 |
| EP | 1923452 | | 5/2008 |
| FR | 2913235 | | 9/2008 |
| GB | 1098698 | | 1/1968 |
| JP | 07-265689 | | 10/1995 |
| JP | 2000282063 | | 10/2000 |
| JP | 2001019984 | A | 1/2001 |
| JP | 2001192676 | | 7/2001 |
| JP | 2003049180 | A | 2/2003 |
| JP | 2003277770 | | 10/2003 |
| JP | 2005015533 | | 1/2005 |
| WO | WO9600269 | | 1/1996 |
| WO | WO9967345 | | 12/1999 |
| WO | WO0179391 | | 10/2001 |
| WO | WO02053684 | | 7/2002 |
| WO | WO 2004/067682 | A1 | 8/2004 |
| WO | WO2005005582 | | 1/2005 |

(56) References Cited

FOREIGN PATENT DOCUMENTS

| | | |
|---|---|---|
| WO | WO2007015391 | 2/2007 |
| WO | 2009073446 A2 | 6/2009 |
| WO | WO2009070561 | 6/2009 |

OTHER PUBLICATIONS

Y. Sano, K.H. Choi, Y. Korai, I. Mochida, "Selection and Further Activation of Activated Carbons for Removal of Nitrogen Species in Gas Oil as a Pretreatment for Its Deep Hydrodesulfurization", Energy & Fuels (2004), pp. 644-651, vol. 18.
Y. Sano, K. Sugahara, K.H. Choi, Y. Korai, I. Mochida, "Two-step adsorption process for deep desulfurization of diesel oil", Fuel (2005), pp. 903-910, vol. 84, Elsevier Ltd.
Y. Sano, K. Choi, Y. Korai, I. Mochida, "Adsorptive removal of sulfur and nitrogen species from a straight run gas oil for its deep hydrodesulfurization", American Chemical Society, Fuel Chemistry Division Preprints (2003), vol. 48(1), pp. 138-139.
Y. Sano, K. Choi, Y. Korai, I. Mochida, "Adsorptive removal of sulfur and nitrogen species from a straight run gas oil over activated carbons for its deep hydrodesulfurization", Applied Catalysis B: Environmental (2004), vol. 49, pp. 219-225.
Y. Sano, K. Choi, Y. Korai, I. Mochida, "Effects of nitrogen and refractory sulfur species removal on the deep HDS of gas oil", Applied Catalysis B: Environmental (2004), vol. 53, pp. 169-174.
K. Choi, N. Kunisada, Y. Korai, I. Mochida, K. Nakano, "Facile ultra-deep desulfurization of gas oil through two-stage or -layer catalyst bed", Catalysis Today (2003), vol. 86, pp. 277-286.
K. Choi, Y. Korai, I. Mochida, J. Ryu, W. Min, "Impact of removal extent of nitrogen species in gas oil on its HDS performance: an efficient approach to its ultra deep desulfurization", Applied Catalysis B: Environmental (2004), vol. 50, pp. 9-16.
Y. Sano, K Choi, Y. Korai, I. Mochida, "Selection and Further Activation of Activated Carbons for Removal of Nitrogen Species in Gas Oil as a Pre-Treatment for Deep Desulfurization" American Chemical Society, Fuel Chemistry Division Preprints (2003), vol. 48(2), pp. 658-659.
Masaomi Amemiya, Yozo Korai, and Isao Mochida, "Catalyst Deactivation in Distillate Hydrotreating (Part 2) Raman Analysis of Carbon Deposited on Hydrotreating Catalyst for Vacuum Gas Oil," Journal of the Japan Petroleum Institute (2003), pp. 99-104, vol. 46, No. 2.
Edward Furimsky and Franklin E. Massoth, "Deactivation of hydroprocessing catalysts," Catalysis Today (1999), pp. 381-495, vol. 52.
Min "A Unique Way to Make Ultra Low Sulfur Diesel," Korean Journal of Chemical Engineering, vol. 19, No. 4 (2002) pp. 601-606, XP008084152.
Examiner's Report issued in EP Patent Application No. 08858377.8, dated Oct. 4, 2011 (6 pages).
Sara E. Skrabalak et al., "Porous MoS2 Synthesized by Ultrasonic Spray Pyrolysis" J. Am. Chem. Soc. 2005, 127, 9990-9991.
Ki-Hyouk Choi et al., "Preparation and Characterization on nano-sized CoMo/AI2O3 catalyst for hydrodesulfurization, " Applied Catalysis A: General 260 (2004) 229-236.
K. Choi et al., "Preparation of CO2 Absorbent by Spray Pyrolysis," Chemistry Letters, vol. 32, No. 10 (2003), p. 924-925.
Y. Okamoto et al., "A study on the preparation of supported metal oxide catalysts using JRC-reference catalysts. I. Preparation of a molybdena-alumina catalyst. Part 1. Surface area of alumina, " Applied Catalysis A: General 170 (1998), p. 315-328.
Messing et al., "Ceramic Powder Synthesis by Spray Pyrolysis," Journal of the American Ceramic Society, vol. 76, No. 11, pp. 2707-2726 (1993).
Okuyama at al., "Preparation of nanoparticles via spray route," Chemical Engineering Science, vol. 58, pp. 537-547 (2003).
Uematsu et al., "New application of spray reaction technique to the preparation of supported gold catalysts for environmental catalysis," Journal of Molecular Catalysis A: Chemical 182-183, pp. 209-214 (2002).
Mizushima et al., "Preparation of Silica-supported Nickel Catalyst by Fume Pyrolysis: Effects of Preparation Conditions of Precursory Solution on Porosity and Nickel Dispersion," Journal of the Japan Petroleum Institute, vol. 48, No. 2, pp. 90-96 (2005).
Tim Old and Jeff Vander Lan, ConocoPhillips S ZorbTM Sulfur Removal Technology: A Proven Solution to the ULSG Challenge, ERTC 9th Annual Meeting, Prague, pp. 1-16, presented at the ERTC 9th Annual Meeting, Refining & Petrochemical, Apr. 27-29, 2005, Kuala Lumpur, Malaysia.
Gary, J. H., "Petroleum Refining Technology and Economics," 5th ed., CRC Press, 463 pgs (2007).
EP Examiner's Report issued in EP Patent Application No. 08857250.8, dated Jun. 28, 2011 (13 pages).
Gao et al., "Adsorption and reduction of NO2 over activated carbon at low temperature," Fuel Processing Technology 92, 2011, pp. 139-146, Elsevier B.V.
M. Te et al., "Oxidation reactivities of dibenzothiophenes in polyoxometalate/H2O2 and formic acid/H2O2 systems," Applied Catalysis A: General 219 (2001), p. 267-280.
P. De Filippis et al., "Oxidation Desulfurization: Oxidation Reactivity of Sulfur Compunds in Different Organic Matrixes," Energy & Fuels, vol. 17, No. 6 (2003), p. 1452-1455.
K. Yazu et al., "Oxidative Desulfurization of Diesel Oil with Hydrogen Peroxide in the Presence of Acid Catalyst in Diesel Oil/Acetic Acid Biphasic System," Chemistry Letters, vol. 33, No. 10 (2004), p. 1306-1307.
S. Otsuki et al., "Oxidative Desulfurization of Light Gas Oil and Vacuum Gas Oil by Oxidation and Solvent Extraction," Energy & Fuels, vol. 14, No. 6 (2000), p. 1232-1239.
J.T. Sampanthar et al., "A novel oxidative desulfurization process to remove refractory sulfur compounds from diesel fuel," Applied Catalysis B: Environmental 63 (2006), p. 85-93.
A. Chica et al., "Catalytic oxidative desulfurization (ODS) of diesel fuel on a continuous fixed-bed reactor," Journal of Catalysis, vol. 242 (2006), p. 299-308.
K. Yazu et al., "Immobilized Tungstophosphoric Acid-catalyzed Oxidative Desulfurization of Diesel Oil with Hydrogen Peroxide," Journal of Japan Petroleum Institute, vol. 46, No. 6 (2003), p. 379-382.
S. Murata et al., "A Novel Oxidative Desulfurization System for Diesel Fuels with Molecular Oxygen in the Presence of Cobalt Catalysts and Aldehydes," Energy & Fuels, vol. 18, No. 1 (2004), p. 116-121.
I. Mochida et al., "Kinetic study of the continuous removal of Sox on polyacrylonitrile-based activated carbon fibres," Fuel, vol. 76, No. 6 (1997), p. 533-536.
I. Mochida et al., "Removal of Sox and Nox over activated carbon fibers," Carbon, vol. 38 (2000), p. 227-239.
N. Shirahama et al., "Mechanistic study on adsorption and reduction of NO2 over activated carbon fibers," Carbon, vol. 40 (2002), p. 2605-2611.
E. Raymundo-Pinero et al., "Temperature programmed desorption study on the mechanism of SO2 oxidation by activated carbon and activated carbon fibres," Carbon, vol. 39 (2001) p. 231-242.
Mochida et al., "Adsorption and Adsorbed Species of SO2 during its Oxidative Removal over Pitch-Based Activated Carbon Fibers," Energy & Fuels, vol. 13, No. 2, 1999, pp. 369-373.
Zhou et al., "Deep Desulfurization of Diesel Fuels by Selective Adsorption with Activated Carbons," Prepr. Pap.-Am. Chem. Soc., Div. Pet, Chem, 2004, 49(3), pp. 329-332.
Kouzu et al., "Catalytic potential of carbon-supported Ni-Mo-sulfide for ultra-deep hydrodesulfurization of diesel fuel," Applied Catalysis A: General 265 (2004) 61-67.
Pawelec et al., "Carbon-supported tungsten and nickel catalysts for hydrodesulfurization and hydrogenation reactions," Applied Catalysis A: General 206 (2001) 295-307.
Farag et al., "Carbon versus alumina as a support for Co-Mo catalysts reactivity towards HDS of dibenzothiophenes and diesel fuel," Catalysis Today 50 (1999) 9-17.
Adschiri et al. "Hydrogenation through Partial Oxidation of Hydrocarbon in Supercritical Water", published in Int. J. of the Soc. of Mat. Eng. for Resources, vol. 7, No. 2, pp. 273-281, (1999).

(56) References Cited

OTHER PUBLICATIONS

Adschiri et al. "Catalytic Hydrodesulfurization of Dibenzothiophene through Partial Oxidation and a Water-Gas Shift Reaction in Supercritical Water", published in Ind. Eng. Chem. Res., vol. 37, pp. 2634-2638, (1998).
Sato et al. "Upgrading of asphalt with and without partial oxidation in supercritical water", published in Science Direct, Fuel, vol. 82, pp. 1231-1239 (2003).
Choi et al., "Petroleum Upgrading and Desulfurizing Process," U.S. Appl. No. 13/009,062, filed Jan. 19, 2011.
PCT International Search Report and Written Opinion dated Mar. 29, 2012, International Application No. PCT/US2011/041413, International Filing Date Jun. 22, 2011.
Kishita, A., Takahashi, S., Kamimura, H., Miki, M., Moriya, T., and Enomoto, H., Upgrading of Bitumen by Hydrothermal Visbreaking in Supercritical Water with Alkali, Journal of the Japan Petroleum Institute, 2003, 215-221, 46 (4).
Amestica, L.A. and Wolf, E.E., Catalytic Liquefaction of Coal With Supercritical Water/CO/Solvent Media, XP-002663069, Fuel, Sep. 30, 1986, pp. 1226-1332, vol. 65, Butterworth & Co, (1986).
Robinson, P.R. and Kraus, L.S., Thermochemistry of Coking in Hydroprocessing Units: Modeling Competitive Naphthalene Saturation and Condensation Reactions, XP-002663070, Apr. 26, 2006, Retrieved from Internet (see attached PCT Int'l Search Report dated Nov. 21, 2011).
PCT International Search Report dated Nov. 21, 2011, International Application No. PCT/US2011/051192, International Filing Date: Sep. 12, 2011.
Parker, R.J. and Simpson, P.L., Liquefaction of Black Thunder Coal with Counterflow Reactor Technology, XP-002663163, Ninth Pittsburgh Coal Conference, Oct. 31, 1992, pp. 1191-1195, Retrieved from Internet (see attached PCT Int'l Search Report dated Nov. 23, 2011).
McCall, T.F., Technology Status Report—Coal Liquefaction, Cleaner Coal Technology Programme, XP-002663181, Department of Trade of Industry of the United Kingdom, Oct. 31, 1999, pp. 1-14, Retrieved from Internet (see attached PCT Int'l Search Report dated Nov. 23, 2011).
PCT International Search Report dated Nov. 23, 2011, International Application No. PCT/US2011/051183, International Filing Date: Sep. 12, 2011.
State Intellectual Property Office (SIPO) Search Report dated Feb. 25, 2014; Chinese Patent Application No. 201180032487.6; Search Report issued with Office Action in corresponding Chinese Application.

* cited by examiner

REMOVAL OF SULFUR COMPOUNDS FROM PETROLEUM STREAM

TECHNICAL FIELD OF THE INVENTION

The present invention relates to a process for upgrading oil by contacting a hydrocarbon stream with supercritical water fluid and then subsequently introducing an alkaline solution to extract sulfur containing compounds. In particular, the hydrothermal upgrading process is conducted in the absence of externally provided hydrogen or catalysts to produce a high value crude oil having low sulfur, low nitrogen, low metallic impurities, and an increased API gravity for use as a hydrocarbon feedstock.

BACKGROUND OF THE INVENTION

World-wide demand for petroleum products has increased dramatically in recent years, depleting much of the known, high value, light crude oil reservoirs. Consequently, production companies have turned their interest towards using low value, heavy oil in order to meet the ever increasing demands of the future. However, because current refining methods using heavy oil are less efficient than those using light crude oils, refineries producing petroleum products from heavier crude oils must refine larger volumes of heavier crude oil in order to get the same volume of final product. Unfortunately though, this does not account for the expected increase in future demand. Further exacerbating the problem, many countries have implemented or plan to implement more strict regulations on the specifications of the petroleum-based transportation fuel. Consequently, the petroleum industry is seeking to find new methods for treating heavy oil prior to refining in an effort to meet the ever-increasing demand for petroleum feedstocks and to improve the quality of available oil used in refinery processes.

In general, heavy oil provides lower amounts of the more valuable light and middle distillates. Additionally, heavy oil generally contains increased amounts of impurities, such as sulfur, nitrogen and metals, all of which generally require increased amounts of hydrogen and energy for hydroprocessing in order to meet strict regulations on impurity content in the final product.

Heavy oil, which is generally defined as bottom fraction from atmospheric and vacuum distillatory, also contains a high asphaltene content, high sulfur content, high nitrogen content, and high metal content. These properties make it difficult to refine heavy oil by conventional refining processes to produce end petroleum products with specifications that meet strict government regulations.

Low-value, heavy oil can be transformed into high-value, light oil by cracking the heavy fraction using various methods known in the art. Conventionally, cracking and cleaning have been conducted using a catalyst at elevated temperatures in the presence of hydrogen. However, this type of hydroprocessing has a definite limitation in processing heavy and sour oil.

Additionally, distillation and/or hydroprocessing of heavy crude feedstock produce large amounts of asphaltene and heavy hydrocarbons, which must be further cracked and hydrotreated to be utilized. Conventional hydrocracking and hydrotreating processes for asphaltenic and heavy fractions also require high capital investments and substantial processing.

Many petroleum refineries perform conventional hydroprocessing after distilling oil into various fractions, with each fraction being hydroprocessed separately. Therefore, refineries must utilize the complex unit operations for each fraction. Further, significant amounts of hydrogen and expensive catalysts are utilized in conventional hydrocracking and hydrotreating processes. The processes are carried out under severe reaction conditions to increase the yield from the heavy oil towards more valuable middle distillates and to remove impurities such as sulfur, nitrogen, and metals.

Currently, large amounts of hydrogen are used to adjust the properties of fractions produced from conventional refining processes in order to meet the required low molecular weight specifications for the end products; to remove impurities such as sulfur, nitrogen, and metal; and to increase the hydrogen-to-carbon ratio of the matrix. Hydrocracking and hydrotreating of asphaltenic and heavy fractions are examples of processes requiring large amounts of hydrogen, both of which result in the catalyst having a reduced life cycle.

Petroleum continues to be the dominant source for supplying the world's energy needs. However, with increased concern on air quality, world governments have urged producers to remove impurities, in particular, sulfur compounds, from petroleum streams. In particular, transportation fuels (gasoline and diesel) are required to be almost free from sulfur compounds (approximately less than 10 wt ppm sulfur). In order to meet such strict regulation on sulfur contents of transportation fuels, ultra deep desulfurization is generally carried out with distilled stream or cracked stream, which have boiling point ranges for gasoline and diesel.

Generally, desulfurization of the petroleum fraction (distilled & cracked stream) can be achieved by catalytic hydrotreatment in the presence of high pressure hydrogen gas. For heavier fractions of petroleum, catalytic hydrocracking and catalytic hydrotreatment is typically applied with very high pressures of hydrogen in order to convert high molecular weight hydrocarbons to low molecular weight ones, thereby meeting boiling point range requirements for transportation fuels. Catalysts for hydrotreatment and hydrocracking suffer from deactivation caused mainly by poisonous matters contained in feedstock and coking. Hence, high pressures of hydrogen are used to maintain the catalyst life. However, catalysts have certain life time in hydrotreatment and hydrocracking. Therefore, catalysts have to be replaced regularly and frequently. Additionally, the large quantities of hydrogen consumed during hydrotreatment and hydrocracking represent a significant disadvantage, as hydrogen is one of the most important and valuable chemicals in the refining and petrochemical industry.

Non-catalytic and non-hydrogenative thermal cracking of petroleum stream is also used for removing impurities. However, these types of refining processes are only capable of modest impurity removal. Moreover, these processes generally result in a significant amount of coke.

Another option to produce clean transportation fuels is using sweet crude oil having fewer amounts of impurities, in particular, sulfur compounds. By using sweet crude oil, complicated and intensive hydrotreatment and hydrocracking can be carried out with lower operating costs. However, the supply of sweet crude oil is fairly limited, while sour crude oil is found in much larger quantities.

As an alternative to conventional catalytic hydrotreatment/hydrocracking and thermal cracking, contacting hydrocarbons in the presence of supercritical water is beginning to garner more attention. In the prior arts, supercritical or near critical water has been employed as a reaction medium to remove impurities and also crack large molecules into small ones without generating a large amount of coke. However, reactions occurring in supercritical water medium are not clearly identified yet.

The critical point of water is 374° C. and 22.06 MPa. Properties of water change dramatically near critical point. The dielectric constant of water changes from around ∈=78 at ambient condition to around ∈=7 at critical point. Furthermore, small changes of temperature and pressure in supercritical conditions result in wide variation of dielectric constant of water (∈=2-30). Such a wide range of dielectric constants covers non-polar organic solvent such as hexane (∈=1.8) and polar organic solvent such as methanol (∈=32.6). The density of water also changes dramatically at near critical points. At supercritical condition, density of water varies from 0.05 to 0.3 g/ml. Furthermore, supercritical water has much lower viscosity and high diffusivity than subcritical water.

Unique properties of supercritical water have been utilized for facilitating certain reactions. For example, high solubility of organic matters and oxygen gas in supercritical water is utilized for decomposing toxic waste materials (Supercritical Water Oxidation=SCWO).

Hydrocarbon molecules contained in petroleum stream are also more easily dissolved in supercritical water although solubility of hydrocarbon depends on its molecular weight and chemical structure. High temperature condition of supercritical water (>374° C.) generates radical species from hydrocarbon molecules, which are more easily converted to various hydrocarbons through complicated reaction networks. In general, termination through bi-radical reactions cause dimerization followed by coke generation. On the other hand, a hydrocarbon molecule carrying radicals are easily decomposed to smaller ones. Generally speaking, inter-molecular radical reaction generates larger molecules such as coke while intra-molecular radical reaction generates smaller molecules. The generation of a large quantity of coke in conventional thermal cracking of petroleum stream is caused by such inter-molecular radical reaction, whereas the presence of supercritical water as a reaction medium reduces inter-molecular radical reaction by cage effect, thereby facilitating intra-molecular radical reactions such as decomposition and isomerization. Therefore, the use of supercritical water allows for the petroleum stream to be converted to a lighter stream with negligible amount of coke.

Impurity removal is also possible with aid of supercritical water; however, the prior arts teach that supercritical water is more effective in decreasing viscosity than in desulfurization.

For example, Atsushi Kishita et al. (Journal of the Japanese Petroleum Institute, vol. 46, pp. 215-221, 2003) treated Canadian bitumen with supercritical water by using batch reactor. After 15 minute reaction at 430° C., the viscosity of bitumen decreased drastically from $2.8\times10^4$ mPa*S to 28 mPa*S, while the sulfur content decreased only from 4.8 wt % sulfur to 3.5 wt % sulfur. The amount of coke generated by the disclosed treatment was 9.6 wt % of feed bitumen.

Limited performance of supercritical water in removing impurities, in particular, sulfur, from petroleum stream is attributed to the limited availability of hydrogen. Although higher operating temperatures are certainly beneficial to improve desulfurization performance, heavy-duty reactor material and large quantities of energy are required to reach such high operating temperatures, e.g., over 450° C.

Feeding hydrogen with the petroleum stream is also beneficial to improve desulfurization. Hydrogen can be supplied by hydrogen gas or other chemicals which can generate hydrogen through certain reaction. For example, carbon monoxide can generate hydrogen by water gas shift reaction. Also, oxygen can be used to generate hydrogen through oxidation of hydrocarbons included in petroleum stream and following water gas shift reaction. However, injecting high pressure gases along with the petroleum stream and water causes many difficulties in handling and safety. Additionally, chemicals such as formaldehyde, can also be used to generate hydrogen through decomposition; however, adding chemicals in with the supercritical water decrease process economy and leads to greater complexities.

Therefore, it would be desirable to have an improved process for upgrading oil with supercritical water fluid that requires neither an external supply of hydrogen nor the presence of an externally supplied catalyst. It would be advantageous to create a process and apparatus that allows for the upgrade of the oil, rather than the individual fractions, to reach the desired qualities such that the refining process and various supporting facilities can be simplified.

Additionally, it would be beneficial to have an improved process that did not require complex equipment or facilities associated with other processes that require hydrogen supply or coke removal systems so that the process may be implemented at the production site.

SUMMARY OF THE INVENTION

The present invention is directed to a process that satisfies at least one of these needs. The present invention includes a process for upgrading heavy oil using supercritical water and a subsequent alkaline extraction. Advantageously, the process can be practiced in the absence of externally supplied hydrogen or externally supplied catalyst. The process generally includes introducing a reaction mixture of sour hydrocarbons and water into a reaction zone and subjecting the reaction mixture to operating conditions that are at or exceed the supercritical conditions of water, such that at least a portion of hydrocarbons in the reaction mixture undergo cracking to form an upgraded mixture, wherein at least a portion of sulfur compounds are converted to hydrogen sulfide and thiol compounds. The reaction zone is essentially free of an externally-provided catalyst and externally-provided alkaline solutions. Following the upgrading step, the upgraded mixture is cooled to a first cooling temperature that is below the critical temperature of water to form a cooled upgraded-mixture, with the cooled upgraded-mixture defining an oil phase and an aqueous phase. Those of ordinary skill in the art will recognize that the cooled-upgraded mixture can be intimately mixed such that an emulsion is formed having one phase within the other (oil-in-water, water-in-oil, or double emulsion). An alkaline solution can be mixed with the cooled upgraded-mixture in a mixing zone in order to extract a substantial portion of the thiol compounds from the oil phase into the aqueous phase. In one embodiment, the alkaline solution is made from an alkali salt and water. Preferred alkali salts include sodium hydroxide, potassium hydroxide, and combinations thereof. The cooled upgraded-mixture can be separated into a gas stream and an upgraded liquid stream, wherein the gas stream contains a substantial portion of the hydrogen sulfide. The upgraded liquid stream can then be separated into upgraded oil and recovered water. The upgraded oil has reduced amounts of asphaltene, sulfur, nitrogen or metal containing substances and an increased API gravity as compared to the hydrocarbons within the reaction mixture. The recovered water includes water and a transformed thiol compound.

In another embodiment, the process can further include cooling the cooled upgraded-mixture to a second cooling temperature following the step of mixing the alkaline solution and prior to the step of separating the cooled upgraded-mixture. The first cooling temperature is preferably between 100° C. and 300° C., more preferably between 150° C. and 250° C.

In one embodiment, the reaction zone is essentially free of an externally-provided hydrogen source.

In another embodiment, the process further includes combining a hydrocarbon stream with a water stream in a mixing zone to form the reaction mixture while keeping the temperature of the reaction mixture below 150° C. Additionally, the reaction mixture can be subjected to ultrasonic energy to create a submicromulsion. The submicromulsion can then be pumped through a preheating zone using a high pressure pump. The high pressure pump increases the pressure of the submicromulsion to a target pressure that is at or above the critical pressure of water prior to the step of introducing the reaction mixture into the reaction zone. In another embodiment the process can further include the step of heating the submicromulsion to a first target temperature, to create a pre-heated submicromulsion, prior to the step of introducing the reaction mixture into the reaction zone and subsequent to the step of combining the hydrocarbon stream with the water stream. Preferably, the first target temperature is in the range of about 150° C. to 350° C.

In one embodiment, the reaction mixture preferably has a volumetric flow ratio of about 10:1 to about 1:50 of the hydrocarbon stream to the water stream at standard conditions. More preferably, the volumetric flow ratio is about 10:1 to about 1:10 of the hydrocarbon stream to the water stream at standard conditions.

In another embodiment, the process can also include the step of recycling the recovered water by combining at least a portion of the recovered water with the water stream to form the reaction mixture. Additionally, the process can further include the step of treating the recovered water in the presence of an oxidant at conditions that are at or above the supercritical conditions of water such that a cleaned recovered water stream is produced, such that the cleaned recovered water streams contains substantially less hydrocarbon content than the recovered water. Preferably, the oxidant is supplied by an oxygen source selected from the group consisting of air, liquefied oxygen, hydrogen peroxide, organic peroxide and combinations thereof.

In another embodiment of the present invention, the process for removing sulfur compounds from the hydrocarbon stream includes the steps of introducing the reaction mixture into the reaction zone, subjecting the reaction mixture to operating conditions that are at or exceed the supercritical conditions of water, such that at least a portion of hydrocarbons in the reaction mixture undergo cracking to form an upgraded mixture, wherein at least a portion of the sulfur compounds are converted to hydrogen sulfide and thiol compounds, and wherein the reaction zone is essentially free of an externally-provided catalyst and externally provided alkaline solutions. The upgraded mixture can be cooled to a first cooling temperature that is below the critical temperature of water to form a cooled upgraded-mixture. The cooled upgraded-mixture can be separated into a gas stream and a liquid stream. Preferably, the gas stream contains a substantial portion of the hydrogen sulfide. The alkaline feed is introduced and mixed with the liquid stream in a mixing zone to produce an upgraded liquid stream, wherein the upgraded liquid stream has an aqueous phase and an oil phase. During the mixing step, a substantial portion of the thiol compounds are extracted from the oil phase into the aqueous phase. The upgraded liquid stream can be separated into upgraded oil and recovered water. The upgraded oil has reduced amounts of asphaltene, sulfur, nitrogen or metal containing substances and an increased API gravity as compared to the hydrocarbon stream, and the recovered water includes water and transformed thiol compound.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

While the invention will be described in connection with several embodiments, it will be understood that it is not intended to limit the invention to those embodiments. On the contrary, it is intended to cover all the alternatives, modifications and equivalence as may be included within the spirit and scope of the invention defined by the appended claims.

Figure 1:
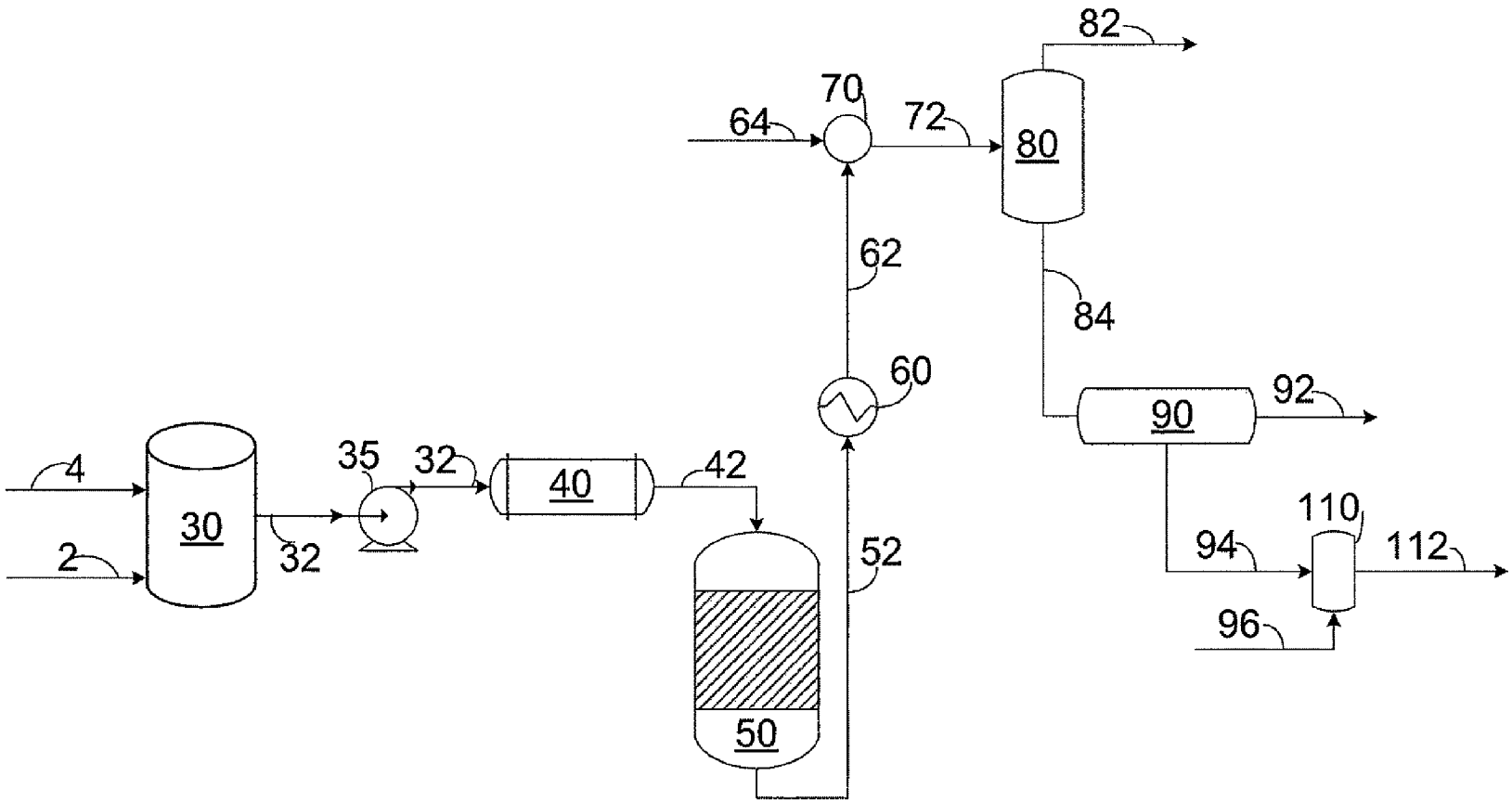
FIG. 1 is an embodiment of the present invention.

Referring to FIG. 1, water stream 2 and hydrocarbon stream 4 are combined in mixing zone 30 to create the reaction mixture. The reaction mixture is transferred through line 32 using high pressure pump 35 to raise the pressure of the reaction mixture to exceed the critical pressure of water. In an embodiment not shown, water stream 2 and hydrocarbon stream 4 can be individually pressurized and/or individually heated prior to combining. Exemplary pressures include 22.06 MPa to 30 MPa, preferably 24 MPa to 26 MPa. In one embodiment, the volumetric flow rate of hydrocarbon stream 4 to water stream 2 at standard conditions is 0.1:1 to 1:10, preferably 0.2:1 to 1:5, more preferably 0.5:1 to 1:2. Exemplary temperatures for hydrocarbon stream 4 are within 50° C. to 650° C., more preferably, 150° C. to 550° C. Acceptable heating devices can include strip heaters, immersion heaters, tubular furnaces, or others known in the art.

In one embodiment, the process includes introducing the reaction mixture to preheating device 40, where it is preferably heated to a temperature of about 250° C., before being fed into reaction zone 50 via line 42. The operating conditions within reaction zone 50 are at or above the critical point of water, which is approximately 374° C. and 22.06 MPa. During this period of intense heat and pressure, the reaction mixture undergoes cracking and forms the upgraded mixture. At this point, the sulfur compounds that were in hydrocarbon stream 4 are converted to $H_2S$ and thiol compounds, with the thiol compounds generally being found in the oil phase of the upgraded mixture. Exemplary reaction zones 50 include tubular type reactors, vessel type reactor equipped with stirrers, or other devices known in the art. Horizontal and/or vertical type reactors can be used. Preferably, the temperature within reaction zone 50 is between 380° C. to 500° C., more preferably 390° C. to 500° C., most preferably 400° C. to 450° C. Preferred residence times within reaction zone 50 are between 1 second to 120 minutes, more preferably 10 seconds to 60 minutes, most preferably 30 seconds to 20 minutes.

The upgraded mixture then moves to first cooler 60 via line 52, where it is cooled to a temperature below the critical temperature of water prior to mixing with alkaline solution 64 in extraction zone 70. First cooler 60 can be a chiller, heater exchanger or any other cooling device known in the arts. In one embodiment, the temperature of cooled upgraded-mixture 62 is between 5° C. and 200° C., more preferably, 10° C. and 150° C., most preferably 50° C. and 100° C. In one embodiment, the apparatus can include a pressure regulating device (not shown) to reduce the pressure of the upgraded mixture before it enters extraction zone 70. Those of ordinary skill in the art will readily recognize acceptable pressure regulating devices. In one embodiment, the residence time of the extraction fluid in extraction zone 70 is 1-120 minutes, preferably, 10-30 minutes. During this mixing step, the alkalines help to extract the thiol compounds from the oil phase into the water phase. Exemplary extraction zones 70 include tubular type or vessel type. In some embodiments, extraction zones 70 can include a mixing device such as a rotating impeller. Preferably, extraction zone 70 is purged with nitrogen or helium to remove oxygen within extraction zone 70. In one embodiment, the temperature within extraction zone 70 is maintained at 10° C. to 100° C., more preferably 30° C. to 70° C.

Subsequent the extraction step, extraction fluid 72 is fed to liquid-gas separator 80 where gas stream 82 is removed after depressurizing extraction fluid 72. Preferred pressure is between 0.1 MPa to 0.5 MPa, more preferably 0.01 MPa to 0.2 MPa.

Upgraded liquid stream 84 is then sent to oil-water separator 90 where recovered water 94 and upgraded oil 92 are separated. Upgraded oil 92 has reduced amounts of asphaltene, sulfur, nitrogen or metal containing substances and an increased API gravity as compared to hydrocarbon stream 4. In an optional step, recovered water 94 can be introduced along with oxidant stream 96 into oxidation reactor 110 in order to help remove contaminants from recovered water 94 to form cleaned water 112.

Figure 2:
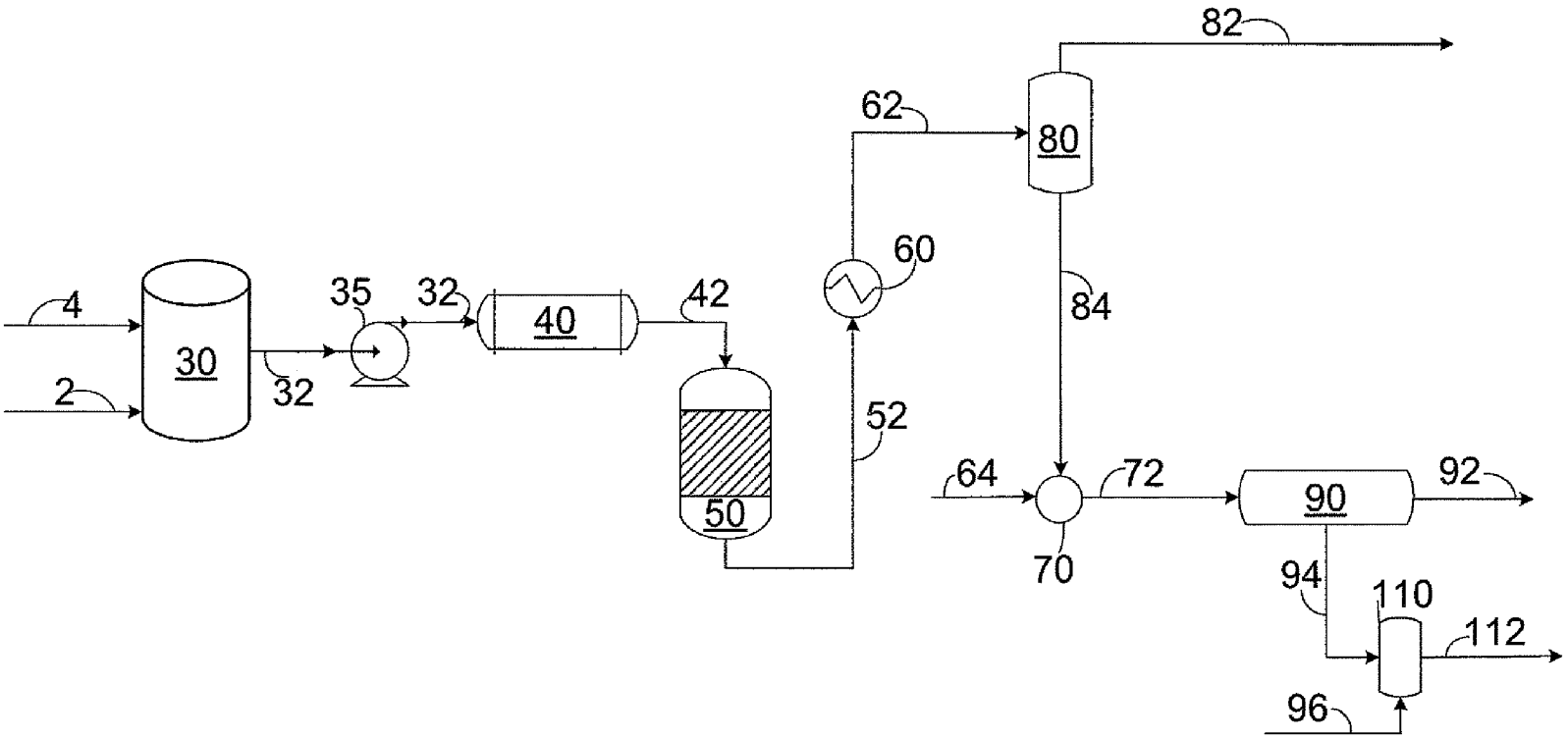
FIG. 2 shows an alternate embodiment of the invention.

FIG. 2 represents an alternate embodiment in which cooled upgraded-mixture 62 is introduced to extraction zone 70 after liquid-gas separator 80 instead of before liquid-gas separator 80. In this embodiment, the pressure regulating device (not shown) can be employed at any point between reaction zone 50 and liquid-gas separator 80.

Figure 3:
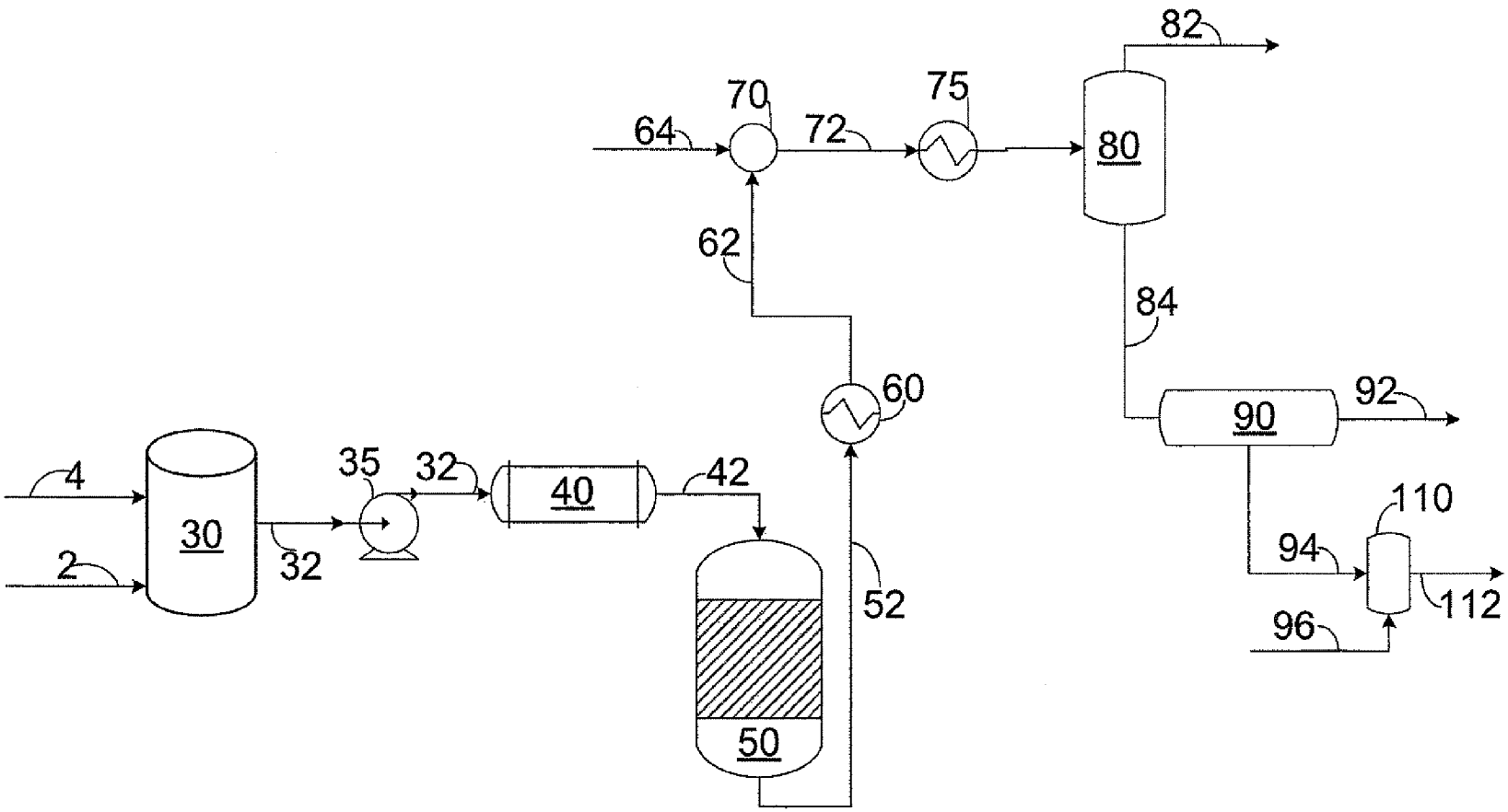
FIG. 3 shows an alternate embodiment of the invention.

FIG. 3 represents an alternate embodiment that is similar to the embodiment shown in FIG. 1, with the addition of second cooler 75. In embodiments in which both first cooler 60 and second cooler 75 are present, the temperature profile of cooled upgraded-mixture 62 and extraction fluid 72 can be more precisely controlled. Preferably, the temperature of cooled upgraded-mixture 62 is between 100° C. and 300° C., more preferably 150° C. to 200° C. In embodiments in which extraction zone 70 is located between first cooler 60 and second cooler 75, the process advantageously allows for maintenance of the temperature of steam, which is extracted with alkaline solution (preferably at a temperature above 150° C.), while maintaining liquid phase of the stream since there is no pressure reducing element prior to extraction zone 70. With higher extraction temperatures, solubility of thiols in the water increases as well. The net effect therefore is increased extraction yield. Additionally, since water is in subcritical state, alkaline compounds do not precipitate in extraction zone 70, which helps to keep the process running efficiently.

Baseline Product

Whole range Arabian Heavy crude oil (AH) and deionized water (DW) were pressurized by metering pumps to 25 MPa. Mass flow rates of AH and DW at standard condition were 0.509 and 0.419 kg/hour, respectively. Pressurized AH was combined with water after pre-heating pressurized water to 490° C. Reaction zone was maintained at 450° C. Residence time of AH and water mixture was estimated to be around 3.9 minutes. After cooling and depressurizing, liquid product was obtained. Total liquid yield was 91.4 wt %. Total sulfur content of AH and product were measured as 2.91 wt % sulfur and 2.49 wt % sulfur (roughly 0.4 wt % reduction).

Improved Product

The baseline product was treated by an alkaline solution containing 10 wt % NaOH. The alkaline solution was added to the baseline product by 1:1 wt/wt. After mixing by magnetic stirrer, the mixture was subjected to ultrasonic irradiation for 1.5 minutes. After 10 minutes, the mixture was centrifuged at 2500 rpm for 20 minutes. The oil phase was separated from the water phase and analyzed by total sulfur analyzer. Total sulfur content was decreased to 2.30 wt % sulfur (an additional 0.2 wt % reduction).

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed.

We claim:

1. A process for removing sulfur compounds from a hydrocarbon stream, the process comprising the steps of:

(a) introducing a reaction mixture into a reaction zone, wherein the reaction mixture comprises a mixture of the hydrocarbon stream and a water stream, wherein the hydrocarbon stream contains sulfur compounds;

(b) subjecting the reaction mixture to operating conditions that are at or exceed the supercritical conditions of water, such that at least a portion of hydrocarbons in the reaction mixture undergo cracking to form an upgraded mixture, wherein at least a portion of the sulfur compounds are converted to hydrogen sulfide and thiol compounds, and wherein the reaction zone is essentially free of an externally-provided catalyst and externally-provided alkaline solutions;

(c) cooling the upgraded mixture to a first cooling temperature that is below the critical temperature of water to form a cooled upgraded-mixture, the cooled upgraded-mixture defining an oil phase and an aqueous phase;

(d) mixing an alkaline solution with the cooled upgraded-mixture in a mixing zone such that a substantial portion of the thiol compounds are extracted from the oil phase into the aqueous phase, the alkaline solution comprising an alkali salt and water;

(e) separating the cooled upgraded-mixture into a gas stream and an upgraded liquid stream, wherein the gas stream contains a substantial portion of the hydrogen sulfide; and (f) separating the upgraded liquid stream into upgraded oil and recovered water, wherein the upgraded oil has reduced amounts of asphaltene, sulfur, nitrogen or metal containing substances and an increased API gravity as compared to the hydrocarbon stream and the recovered water includes water and a transformed thiol compound.

2. The process of claim 1, further comprising the step of cooling the cooled upgraded-mixture to a second cooling temperature following the step of mixing the alkaline solution and prior to the step of separating the cooled upgraded-mixture, wherein the first cooling temperature is between about 100° C. to 300° C.

3. The process of claim 2, wherein the first cooling temperature is between about 150° C. to 250° C.

4. The process of claim 1, wherein the reaction zone is essentially free of an externally-provided hydrogen source.

5. The process of claim 1, wherein the alkali salt is selected from the group consisting of sodium hydroxide, potassium hydroxide, and combinations thereof.

6. The process of claim 1, further comprising the step of combining the hydrocarbon stream with the water stream in a mixing zone to form the reaction mixture prior to the step of introducing the reaction mixture into the reaction zone, wherein the temperature of the reaction mixture does not exceed 150° C.

7. The process of claim 6, further comprising the step of subjecting the reaction mixture to ultrasonic energy to create a submicromulsion; and pumping the submicromulsion through a pre-heating zone using a high pressure pump, Wherein the high pressure pump increases the pressure of the submicromulsion to a target pressure that is at or above the critical pressure of water prior to the step of introducing the reaction mixture into the reaction zone and subsequent to the step of combining the hydrocarbon stream with the water stream.

8. The process of claim 7, further comprising the step of heating the submicromulsion to a first target temperature, to create a pre-heated submicromulsion, prior to the step of introducing the reaction mixture into the reaction zone and subsequent to the step of combining the hydrocarbon stream with the water stream, the first target temperature being in the range of about 150° C. to 350° C.

9. The process of claim 1, wherein the reaction mixture comprises a volumetric flow ratio of about 10:1 to about 1:50 of the hydrocarbon stream to the water stream at standard conditions.

10. The process of claim 1, wherein the reaction mixture comprises a volumetric flow ratio of about 10:1 to about 1:10 of the hydrocarbon stream to the water stream at standard conditions.

11. The process of claim 1, further comprising the step of recycling the recovered water by combining at least a portion of the recovered water with the water stream to form the reaction mixture.

12. The process of claim 11, further comprising the step of treating the recovered water in the presence of an oxidant at conditions that are at or above the supercritical conditions of water such that a cleaned recovered water stream is produced, such that the cleaned recovered water streams contains substantially less hydrocarbon content than the recovered water.

13. The process of claim 12, wherein the oxidant is supplied by an oxygen source selected from the group consisting of air, liquefied oxygen, hydrogen peroxide, organic peroxide and combinations thereof.

14. A process for removing sulfur compounds from a hydrocarbon stream, the process comprising the steps of:

(a) introducing a reaction mixture into a reaction zone, wherein the reaction mixture comprises a mixture of the hydrocarbon stream and a water stream, wherein the hydrocarbon stream contains sulfur compounds;

(b) subjecting the reaction mixture to operating conditions that are at or exceed the supercritical conditions of water, such that at least a portion of hydrocarbons in the reaction mixture undergo cracking to form an upgraded mixture, wherein at least a portion of the sulfur compounds are converted to hydrogen sulfide and thiol compounds, and wherein the reaction zone is essentially free of an externally-provided catalyst and externally provided alkaline solutions;

(c) cooling the upgraded mixture to a first cooling temperature that is below the critical temperature of water to form a cooled upgraded-mixture;

(d) separating the cooled upgraded-mixture into a gas stream and a liquid stream, wherein the gas stream contains a substantial portion of the hydrogen sulfide;

(e) mixing an alkaline feed with the liquid stream in a mixing zone to produce an upgraded liquid stream, the upgraded liquid stream defining an aqueous phase and an oil phase, such that a substantial portion of the thiol compounds are extracted from the oil phase into the aqueous phase, the alkaline feed comprising an alkali salt and water; and (f) separating the upgraded liquid stream into upgraded oil and recovered water, wherein the upgraded oil has reduced amounts of asphaltene, sulfur, nitrogen or metal containing substances and an increased API gravity as compared to the hydrocarbon stream and the recovered water includes water and a transformed thiol compound.

15. The process of claim 14, wherein the reaction zone is essentially free of an externally-provided hydrogen source.

16. The process of claim 14, wherein the alkali salt is selected from the group consisting of sodium hydroxide, potassium hydroxide, and combinations thereof.

17. The process of claim 14, further comprising the step of combining the hydrocarbon stream with the water stream in a mixing zone to form the reaction mixture prior to the step of introducing the reaction mixture into the reaction zone, wherein the temperature of the reaction mixture does not exceed 150 degrees C.

18. The process of claim 17, further comprising the step of subjecting the reaction mixture to ultrasonic energy to create a submicromulsion; and pumping the submicromulsion through a pre-heating zone using a high pressure pump, wherein the high pressure pump increases the pressure of the submicromulsion to a target pressure at or above the critical pressure of water prior to the step of introducing the reaction mixture into the reaction zone and subsequent to the step of combining the hydrocarbon stream with the water stream.

19. The process of claim 14, further comprising the steps of:

combining the hydrocarbon stream with water in a mixing zone to form the reaction mixture prior to the step of introducing the reaction mixture into the reaction zone, wherein the temperature of the reaction mixture does not exceed 150 degrees C.; and heating the reaction mixture to a first target temperature prior to the step of introducing the reaction mixture into the reaction zone and subsequent to the step of combining the hydrocarbon stream with the water stream, the first target temperature being in the range of about 150° C. to 350° C.

20. The process of claim 14, wherein the reaction mixture comprises a volumetric flow ratio of about 10:1 to about 1:50 of the hydrocarbon stream to the water stream at standard conditions.

21. The process of claim 14, wherein the reaction mixture comprises a volumetric flow ratio of about 10:1 to about 1:10 of the hydrocarbon stream to the water stream at standard conditions.

22. The process of claim 14, further comprising the step of recycling the recovered water by combining at least a portion of the recovered water with the water stream to form the reaction mixture.

23. The process of claim further comprising the step of treating the recovered water in the presence of an oxidant at conditions that are at or above the supercritical conditions of water to create a cleaned recovered water stream, such that the cleaned recovered water streams contains substantially less hydrocarbon content than the recovered water.

24. The process of claim 23, wherein the oxidant is supplied by an oxygen source selected from the group consisting of air, liquefied oxygen, hydrogen peroxide, organic peroxide and combinations thereof.

* * * * *

UNITED STATES PATENT AND TRADEMARK OFFICE

CERTIFICATE OF CORRECTION

PATENT NO. : 9,005,432 B2
APPLICATION NO. : 12/825842
DATED : April 14, 2015
INVENTOR(S) : Ki-Hyouk Choi et al.

It is certified that error appears in the above-identified patent and that said Letters Patent is hereby corrected as shown below:

In the Claims

In Column 9, Line 14, Claim 7, the first word appears as "Wherein" and should read --wherein--.

In Column 10, Line 62, Claim 23, the line appears as "The process of claim further comprising the step of" and should read --The process of claim 22, further comprising the step of--.

Signed and Sealed this
Eighth Day of September, 2015

Michelle K. Lee

Michelle K. Lee
*Director of the United States Patent and Trademark Office*